United States Patent [19]

Allan

[11] Patent Number: 4,664,730

[45] Date of Patent: May 12, 1987

[54] TACTICAL MONOPROPELLANT

[75] Inventor: Barry D. Allan, Huntsville, Ala.

[73] Assignee: The United States of America as represented by the Secretary of the Army, Washington, D.C.

[21] Appl. No.: 848,864

[22] Filed: Apr. 7, 1986

[51] Int. Cl.[4] ..... C06B 47/08

[52] U.S. Cl. ..... 149/36; 149/108.8; 149/120; 149/122

[58] Field of Search ..... 149/36, 108.8, 120, 149/122

[56] References Cited

U.S. PATENT DOCUMENTS

| | | | |
|---|---|---|---|
| 2,943,927 | 7/1960 | Audrieth et al. | 149/36 |
| 2,951,335 | 9/1960 | Stengel | 149/36 |
| 2,982,637 | 5/1961 | Kruse | 149/36 |
| 3,658,609 | 4/1972 | Lum et al. | 149/36 |
| 4,090,895 | 5/1978 | Outten | 149/22 |

*Primary Examiner*—Stephen J. Lechert, Jr.

*Attorney, Agent, or Firm*—John C. Garvin, Jr.; Freddie M. Bush

[57] ABSTRACT

The incorporation of methyl alcohol into a hydrazine, and hydrazine nitrate fuel blend is effective in lowering the freezing point of the combination while enhancing the performance of the monopropellant blend by contributing to the total energy of the monopropellant ternary combination. Hydrazine content varies from about 58 to about 68 weight percent, the hydrazine nitrate varies from about 20 to about 25 weight percent, and the methyl alcohol varies from about 12 to about 17 weight percent. The freezing point of this monopropellant fuel blend has a freezing point from about −29° F. to about −65° F., which renders this monopropellant fuel blend useful as a tactical monopropellant fuel blend over a wide temperature range.

3 Claims, 2 Drawing Figures

TACTICAL MONOPROPELLANT

DEDICATORY CLAUSE

The invention described herein may be manufactured, used, and licensed by or for the Government for governmental purposes without the payment to me of any royalties thereon.

BACKGROUND OF THE INVENTION

Monopropellant, as the name implies, is a single propellant ingredient which provides specific impulse (Isp) as it undergoes decomposition from combustion or decomposition by other means such as by catalytic decomposition. A monopropellant generally has a high freezing point and a low Isp. These properties therefore exclude the use of monopropellants in certain tactical situations.

An extensively used monopropellant such as hydrazine has been used as a rocket fuel. Hydrazine has a melting point of 2° C. Hydrazine dissolves many inorganic substances and forms salts with inorganic acids. For example, hydrazine nitrate, $N_2H_4$. $HNO_3$, has been employed with hydrazine and water to yield a higher specific impulse fuel blend having a lower freezing point. Hydrazine is miscible with water, methyl, ethyl, propyl, and isobutyl alcohols. Hydrazine forms an azeotropic mixture with water with a boiling point at 760 mm of mercury of 120.3° C.

Although adding water to hydrazine lowers the freezing point of the mixture, the addition of a nonenergetic material defeats the purpose of achieving a high specific impulse while lowering the freezing point. A tactical monopropellant should have a wide temperature range for use above and below the standard freezing point for water.

A preferred combination for a tactical monopropellant fuel blend is a monopropellant fuel blend whereby the freezing point is lowered by an additive that is multifunctional, i.e., the additive for making a monopropellant fuel blend lowers the freezing point and also raises the specific impulse.

Therefore, an object of this invention is to provide an additive to a monopropellant which forms a miscible monopropellant fuel blend having a lower freezing point and a higher specific impulse as compared with a standard monopropellant blend of hydrazine, hydrazine nitrate, and water.

A further object of this invention is to provide a monopropellant fuel blend wherein the ingredients are soluble or miscible in sufficient amounts to contribute to the specific impulse while lowering the freezing point of the monopropellant fuel blend thereby enabling the monopropellant fuel blend to be used in tactical systems deployed for use in cold environmental conditions. cl

SUMMARY OF THE INVENTION

The combination of methanol (MeOH), hydrazine, and hydrazine nitrate yields a monopropellant blend having a lower freezing point and a higher specific impulse. This monopropellant fuel blend has a usefulness which extends to cold environments while at the same time it provides a higher specific impulse system. The addition of methanol, (MeOH) while miscible with hydrazine, acts to further reduce the freezing point of the monopropellant fuel blend. Since methanol contributes oxidizer function proportional to the oxygen content, a monopropellant fuel blend consisting of hydrazine, hydrazine nitrate, and methanol offers a variable specific impulse which is achieved by varying the amount of the hydrazine, hydrazine nitrate, and methanol. A suitable amount of MeOH to lower the freezing point temperature will achieve the desired physical properties. A suitable amount of MeOH to achieve the desired physical properties, the desired specific impulse, and the desired, lowered freezing point are considered in combination to arrive at the optimum values of each of the components of the fuel blend. Methyl alcohol has a carbon content of 37.48%, a hydrogen content of 12.58% and an oxygen content of 49.37%. Thus, the oxygen contribution of MeOH and the lowering of the freezing point of the composition are dual contributions of the additive MeOH, but the additional contributing attributes of the elements carbon, and hydrogen render MeOH a superior additive for use with hydrazine and hydrazine nitrate as compared with the additive water. The combination of 68 weight percent hydrazine, 20 weight percent hydrazine nitrate, and 12 weight percent MeOH provides a monopropellant fuel blend with a freezing point of −29° F. A like amount of freezing point depression is achieved with the prior art additive water in an amount of 12 percent in combination with 20 percent hydrazine nitrate and 68 percent hydrazine, but the substitution of alcohol for water increases the energy available without adversely effecting the physical properties of the blend, i.e., viscosity values, and without adversely effecting the performance values, e.g. the small motor test data, and the differential thermal analysis (DTA) values.

DESCRIPTION OF THE PREFERRED EMBODIMENT

Figure 1:
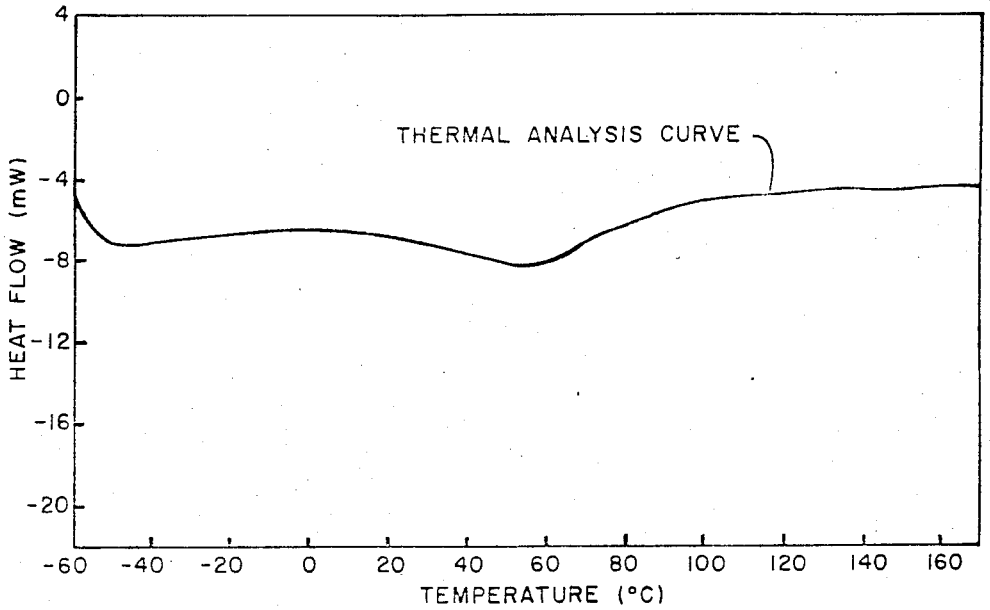
FIG. 1 of the drawing depicts a thermal analysis curve for a monopropellant fuel blend comprised of hydrazine, hydrazine nitrate, and methyl alcohol.

A monopropellant fuel blend consisting from about 58 to about 68 weight percent hydrazine, from about 20 to about 25 weight percent hydrazine nitrate, and from about 12 to about 17 weight percent methyl alcohol (MeOH) is a useful monopropellant in cold environmental conditions. The combination of 68/20/12 (hydrazine/hydrazine nitrate/methyl alcohol) has a freezing point of −29° F. The fact that MeOH also contributes the elements oxygen, hydrogen, and carbon in support of combustion in addition to its function as a freezing point depressant for the hydrazine fuel blend renders it superior as compared with water employed as a freezing point depressant for a like hydrazine fuel blend. A suitable amount of MeOH to achieve the desired physical properties, the desired specific impulse, and the desired, lowered freezing point are considered in combination to arrive at the optimum values of each component of the fuel blend comprised of hydrazine, hydrazine nitrate, and methyl alcohol. Thus, the range of ingredients specified above has a freezing point from about −29° F. to about −65° F. (for methyl alcohol contents from about 12 to about 17 weight percent).

Table I, below, lists condidate fuels which provide freezing point values for the combinations listed.

TABLE I

| FUEL TYPE | BLEND | CANDIDATE FUELS COMPOSITION (%) | Fp (°F.) |
|---|---|---|---|
| 1. $N_2H_4/H_2O$ | H/W | 70 $N_2H_4$/30 $H_2O$ | −65 |
| | | 74 $N_2H_4$/26 $H_2O$ | −29 |
| 2. $N_2H_4/N_2H_5NO_3/H_2O$ | H/HN/W-1 | 58 $N_2H_4$/25 $N_2H_5NO_3$/17 $H_2O$ | −65 |
| 3. $N_2H_4/N_2H_5NO_3/H_2O$ | H/HN/W-2 | 68 $N_2H_4$/20 $N_2H_5NO_3$/12 $H_2O$ | −29 |
| 4. $N_2H_4$/HN/MMH | H/HN/MMH-1 | 13 $N_2H_4$/29 HN/68 MMH | −65 |
| 5. $N_2H_4$/HN/MMH | H/HN/MMH-2 | 26 $N_2H_4$/19 HN/55 MMH | −44 |
| 6. $N_2H_4$/NOAN/$H_2O$ | H/MOAN/W | 68 $N_2H_4$/20 MOAN/12 $H_2O$ | −65 |
| 7. $N_2H_4$/HN/MeOH | H/HN/Me | 68 $N_2H_4$/20 $N_2H_5NO_3$/12 MeOH | −29 |

GLOSSARY
1. Hydrazine nitrate (HN)
2. Methoxyamine nitrate (MOAN)
3. Hydrazine ($N_2H_4$)
4. Methyl alcohol (MeOH)
5. Hydrazine (H)
6. Water (W)
7. Freezing point (Fp)

Comparison of the above fuel combinations, fuel types 1–6, indicate that a 68 weight percent hydrazine, a 20 weight percent hydrazine nitrate, and a 12 weight percent methyl alcohol (fuel type 7) provides a preferred fuel blend of a high percent hydrazine-hydrazine nitrate content having a freezing point of −29° F.

The small scale motor test data values of Table II provides a comparison of fuel types for neat hydrazine (fuel types 1–4), hydrazine-hydrazine nitrate (fuel types 5–8), and the preferred monopropellant fuel blend of this invention comprised of hydrazine, hydrazine nitrate, and methyl alcohol (fuel type 9).

TABLE II

| FUEL TYPE | $T_f$ °F. | TIME SEC | $P_t$ PSIA | $P_c$ PSIA | $T_c$ °F. | $P_c$ 0–100 $P_c$ SEC |
|---|---|---|---|---|---|---|
| | | SMALL SCALE MOTOR TESTS | | | | |
| 1. $N_2H_4$ | 114 | 2.0 | 655 | 398 | 1538 | 0.08 |
| | | 3.0 | 655 | 403 | 1746 | |
| 2. $N_2H_4$ | 57 | 2.5 | 664 | 317 | 1757 | 0.05 |
| 3. $N_2H_4$ | 57 | 2.5 | 1030 | 420 | 1902 | 0.07 |
| 4. $N_2H_4$ | 31 | 2.0 | 649 | 350 | 1546 | 0.05 |
| | | 3.0 | 650 | 348 | 1737 | |
| 5. $N_2H_4$/HN/$H_2O$ | 56 | 2.5 | 507 | 345 | 1645 | 0.11 |
| 6. $N_2H_4$/HN/$H_2O$ | 57 | 2.0 | 645 | 387 | 1761 | 0.10 |
| | | 2.5 | 643 | 393 | 1925 | |
| 7. $N_2H_4$/HN/$H_2O$ | 58 | 2.5 | 733 | 430 | 1841 | 0.10 |
| 8. $N_2H_4$/HN/$H_2O$ | −15 | 2.0 | 657 | 392 | 1395 | |
| | | 3.0 | 656 | 401 | 1728 | 0.08 |
| | | 4.0 | 655 | 400 | 1795 | |
| 9. $N_2H_4$/HN/MeOH | 27 | 2.0 | 678 | 345 | 1329 | |
| | | 3.0 | 678 | 347 | 1648 | 0.09 |
| | | 4.0 | 678 | 346 | 1684 | |

The uniformity of pressure values (Pt and Pc) obtained after an initial fuel temperature (Tf° F.) 27° F. over the time span of 2–4 seconds, after first reaching a chamber pressure (Pc) from 0–100 Pc in only 0.09 seconds authenicates the usefulness of the hydrazine, hydrazine nitrate, and methyl alcohol fuel blend of this invention as a monopropellant.

In further reference to the differential thermal analysis (DTA) curve of FIG. 1, this curve based on a heat flow at a rate of 10 degrees per minute and measured over the temperature range from about −60° C. to about 165° C. shows no abnormalities such as would be indicated by undesirable exotherms or endotherms for the fuel blend comprised of hydrazine, hydrazine nitrate, and methyl alcohol. Such exotherms or endotherms would show evidence of phase changes in the fuel blend. Therefore, this DTA data further confirms the usefulness of this monopropellant fuel blend.

Figure 2:
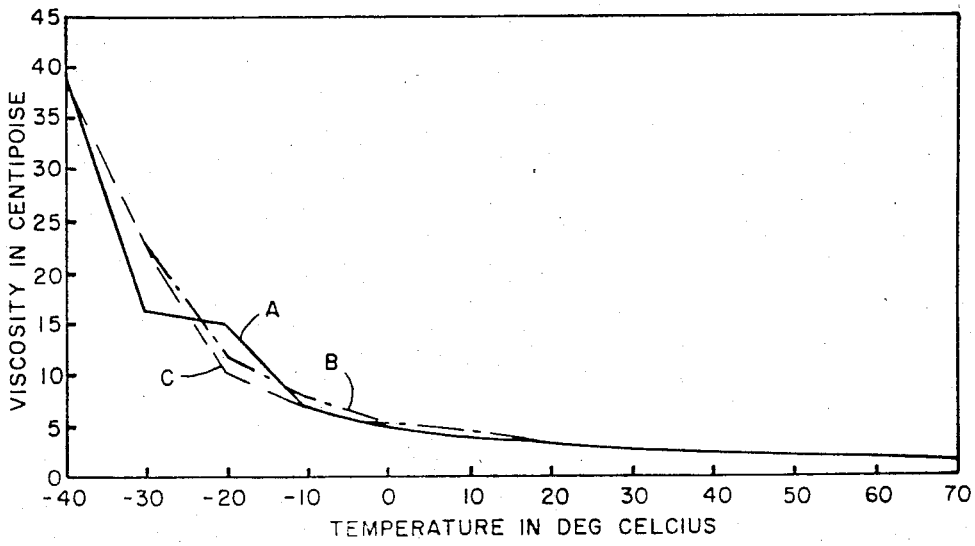
FIG. 2 of the drawing depicts viscosity curves in centipoises for a monopropellant propellant fuel blend comprised of hydrazine, hydrazine nitrate, and methyl alcohol.

In further reference to the viscosity curves A, B, C of FIG. 2, the reproducibility of the monopropellant fuel blend is apparent since the average of these three viscosity curves are substantially duplicates of each other over the temperature range from −40° C. to 70° C. for the monopropellant fuel blend consisting of hydrazine, hydrazine nitrate, and methyl alcohol.

Crystalline hydrazine nitrate and its preparation is described in French Pat. No. 2,276,261 issued on Jan. 23, 1976 to Pascal et al. Hydrazine nitrate is also readily prepared, in situ, from conversion of ammonium nitrate to hydrazine nitrate in an aqueous hydrazine solution.

A related monopropellant composition is disclosed in my co-pending application Ser. No. 789,816 entitled: Nitrate Ester Monopropellant, filed on Oct. 21, 1985, in which I am a co-inventor with Porter H. Mitchell. This co-pending application which is commonly assigned to the U.S. Government as represented by the Department of Army relates to nitrate ester monopropellant comprising hydrazine from about 65 to about 95 weight percent in combination with a nitrate pentaerythritol in a weight percent from about 5 to about 25 selected from the group consisting of the mono-, di-, tri-, and tetranitrated pentaerythritols. This nitrate ester monopropellant can include an optional additive of methyl alcohol with a corresponding adjustment in weight percent of the hydrazine to yield a nitrate ester monopropellant useful in a temperature range as low as −23.7° C., but with a compromise in the specific impulse as compared with a nitrate ester monopropellant containing only hydrazine and pentaerythritol in combination.

I claim:

1. A monopropellant fuel blend having a freezing point from about −29° F. to about −65° F. comprising hydrazine from about 58 to about 68 weight percent, hydrazine nitrate from about 20 to about 25 weight percent, and methyl alcohol from about 12 weight percent to about 17 weight percent, said weight percent range for said hydrazine nitrate and said methyl alcohol being the effective amounts for lowering the freezing point and raising the specific impulse of said monoprollant fuel blend.

2. The monopropellant fuel blend of claim 1 wherein said hydrazine is present in an amount of about 68 weight percent wherein said hydrazine nitrate is present in an amount of about 20 weight percent, wherein said methyl alcohol is present in an amount of about 12 weight percent and wherein said freezing point is about −29° F.

3. The monopropellant fuel blend of claim 1 wherein said hydrazine is present in an amount of about 58 weight percent, wherein said hydrazine nitrate is present in an amount of about 25 weight percent, wherein said methyl alcohol is present in an amount of about 17 weight percent, and wherein said freezing point is about −65° F.

* * * * *